US007182440B2

(12) United States Patent
Miyamoto et al.

(10) Patent No.: US 7,182,440 B2
(45) Date of Patent: Feb. 27, 2007

(54) LIQUID JET APPARATUS

(75) Inventors: Takaaki Miyamoto, Kanagawa (JP); Minoru Kohno, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/474,865

(22) PCT Filed: Apr. 11, 2002

(86) PCT No.: PCT/JP02/03597

§ 371 (c)(1),
(2), (4) Date: Oct. 8, 2003

(87) PCT Pub. No.: WO02/083424

PCT Pub. Date: Oct. 24, 2002

(65) Prior Publication Data

US 2004/0130600 A1 Jul. 8, 2004

(30) Foreign Application Priority Data

Apr. 13, 2001 (JP) ..... 2001-114676

(51) Int. Cl.
*B41J 2/05* (2006.01)

(52) U.S. Cl. ..... 347/64; 347/62

(58) Field of Classification Search ..... 347/20, 347/56–59, 61–65, 67
See application file for complete search history.

(56) References Cited

U.S. PATENT DOCUMENTS

| | | | | |
|---|---|---|---|---|
| 5,010,355 | A * | 4/1991 | Hawkins et al. | 347/64 |
| 5,122,812 | A * | 6/1992 | Hess et al. | 347/59 |
| 5,754,194 | A * | 5/1998 | Endo et al. | 347/56 |

FOREIGN PATENT DOCUMENTS

| | | |
|---|---|---|
| EP | 0729834 A2 | 9/1996 |
| EP | 1 078 758 | 2/2001 |
| JP | 08-300662 | 11/1996 |
| JP | 2000-108355 | 4/2000 |

* cited by examiner

*Primary Examiner*—Juanita D. Stephens
(74) *Attorney, Agent, or Firm*—Sonnenschein Nath & Rosenthal LLP

(57) ABSTRACT

To ensure satisfactory reliability even if the wiring pattern is formed of a wiring material having an enhanced electromigration resistance, by providing a protective layer for protecting heating elements from dry etching for forming a wiring pattern, on the ink chamber side or other liquid chamber side of each heating element.

12 Claims, 6 Drawing Sheets

PARTICLE GENERATION

LIQUID JET APPARATUS

BACKGROUND OF THE INVENTION

The present invention relates to liquid jet heads, liquid jet apparatuses, and methods for manufacturing the liquid jet head. The present invention is particularly applied to a liquid jet apparatus using a thermal head to ensure satisfactory reliability even if a wiring pattern is formed of a wiring material having an enhanced electromigration resistance.

Needs for color hard copies have recently been growing in the field of image processing and the like. According to the needs, methods for making color hard copies are proposed which include a sublimation dye transfer method, a thermofusible transfer method, liquid jet methods such as ink jetting, electrophotography, and a silver salt photothermographic method.

In the liquid jet methods from among those methods, droplets of, for example, a recording liquid (ink) are discharged to form dots from nozzles provided to a recording head onto a recording object. Thus, high-quality images can be output from a simple structure. The liquid jet methods are classified into, for example, the electrostatic attraction system, the continuous vibration generating system (piezo system), and the thermal system by how to discharge liquid such as ink.

In the thermal system, liquid, such as ink, is locally heated to generate bubbles that push the liquid to discharge onto a printing object. Thus, high quality color images can be printed out from a simple structure.

A printer using the thermal system includes a so-called printer head. The printer head includes a semiconductor substrate provided thereon with heating elements for heating a liquid such as ink, a driving circuit using a logic integrated circuit for driving the heating elements, and the like by semiconductor technology.

Specifically, the thermal head has a logic integrated circuit constituted of MOS transistors or bipolar transistors; and driving transistors driven by the logic integrated circuit, on a silicon substrate. Also, Ta, $Ta_2N$, TaAl, or the like is deposited to form a thin film serving as the heating elements, by sputtering. Then, a wiring material, such as aluminium, is deposited and patterned by wet etching to connect the transistors with the respective heating elements. Furthermore, a protective layer, such as a silicon nitride film, and an anti-cavitation layer using a Ta film are formed. The thermal head also includes liquid chambers for holding a liquid such as ink and channels for drawing the liquid to the respective liquid chambers. Thus, the logic driving circuit controls the driving transistors to excite the heating elements, and, thereby, the thermal head discharges ink droplets from the nozzles.

In order to produce a printed output with a high resolution, it is desired that the heating elements are densely arranged in the thermal head. For example, in a printer head having a resolution corresponding to 600 DPI, heating resistors are aligned at intervals of 42.333 μm.

When the driving transistors are connected to the respective heating elements with pure aluminium serving as a wiring material, wet etching with a chemical solution mainly containing phosphoric acid or the like facilitates reliable patterning of the aluminium, without negatively affecting the heating elements.

However, if current is applied to the aluminium, electrons come into collision with aluminium atoms, thereby moving the aluminium atoms. As a result, a deficiency may occur in part of the aluminium wiring pattern. Also, the deficiency may result in a break in the wiring pattern (so-called electromigration deficiency). In the process of preparing semiconductors, accordingly, silicon, copper, or the like is added to aluminium, instead of using pure aluminium, so that aluminium grain boundaries are reinforced with such an additive, thereby enhancing the electromigration resistance.

It is, therefore, considered that the reliability of the thermal head can further be increased by use of a wiring material having an enhanced electromigration resistance. In this instance, therefore, it is considered that electromigration resistance can be enhanced by, for example, forming heating elements 2 and a wiring layer 3 of a wiring material, such as Al—Si or Al—Cu, in that order on a semiconductor substrate 1 including driving transistors, after forming an insulating layer on the semiconductor substrate 1, and by patterning the wiring layer by wet etching, as shown in FIG. 1.

Unfortunately, the additive in the wiring material, such as Si or Cu, does not dissolve in an etching chemical, and, therefore, residues 4 constituted of Si, Cu, or the like remain in the region where the wiring material has been removed by the chemical. In the case of use in the thermal head, this region, where the wiring material has been removed, acts as a source of dust that seriously, adversely affects semiconductor preparing processes.

As one of the solution of this problem, halogen gas plasma (that is, dry etching) may be substituted for wet etching to form an Al—Si or Al—Cu wiring pattern. In this dry etching using a halogen gas, however, the material of the heating elements, such as Ta, $Ta_2N$, or TaAl, is undesirably etched, and, consequently, the reliability of the heating elements is seriously degraded.

Thus, it has been difficult to ensure the reliability of the thermal head by use of a wiring material having an enhanced electromigration resistance.

SUMMARY OF THE INVENTION

The present invention has been accomplished in view above, and is intended to propose a liquid jet head and a liquid jet apparatus having a satisfactory reliability ensured even if a wiring pattern is formed of a wiring material having an enhanced electromigration resistance, and a method for manufacturing the liquid jet head.

In order to solve the problem, the present invention is applied to a liquid jet head, and a protective layer for protecting heating elements from dry etching for forming a wiring pattern is provided on a liquid chamber side of each heating element.

Hence, the present invention is applied to the liquid jet head and various types of apparatus discharging droplets from a desired nozzle, such as a printer head using ink droplets, various dye droplets, and droplets for forming a protective layer as the droplets; a microdispenser, a measuring device, and a testing apparatus using a regent as the droplets; and a pattern drawing apparatus using a chemical for protecting members from etching as the droplets. By providing the protective layer for protecting the heating elements from dry etching for forming the wiring pattern, on the liquid chamber side of the heating elements, the protective layer prevents the dry etching from negatively affecting the heating elements. Thus, the deterioration of the reliability of the heating elements can be prevented effectively even though the wiring pattern is formed of a wiring material having an enhanced electromigration resistance, and, accordingly, satisfactory reliability can be ensured.

Also, the present invention is applied to a liquid jet apparatus. In the liquid jet head of the liquid jet apparatus, a protective layer for protecting heating elements from dry etching for forming a wiring pattern is provided on a liquid chamber side of each heating element.

According to this structure, a liquid jet apparatus can be achieved whose reliability is satisfactorily ensured even though the wiring pattern is formed of a wiring material having an enhanced electromigration resistance.

In addition, the present invention is applied to a method for manufacturing a liquid jet head. The method includes the step of forming a protective layer for protecting heating elements from dry etching for forming a wiring pattern on a liquid chamber side of each heating element.

According to this structure, a method for manufacturing a liquid jet head can be provided by which a liquid jet head is manufactured whose reliability is satisfactorily ensured even though the wiring pattern is formed of a wiring material having an enhanced electromigration resistance.

DETAILED DESCRIPTION OF THE PRESENTLY PREFERRED EMBODIMENTS

An embodiment of the present invention will now be described with reference to the drawings. The present invention is applied to a liquid jet apparatus, a liquid jet head used in the liquid jet apparatus, and a method for manufacturing the liquid jet head. In the following description, ink is used as an example of the liquid discharged from the liquid jet apparatus. The liquid discharged from the liquid jet apparatus is, therefore, not limited to ink, and it may be droplets or the like of a fixer or a diluent of the ink, of dyes, or for forming a protective layer. Also, it, of course, may be a reagent, as in cases of use in a microdispenser, various types of apparatus, various types of testing apparatus, or a chemical for protecting members from etching, as in cases of use in pattern drawing apparatuses or the like.

(1) Structure of an Embodiment

Figure 1:
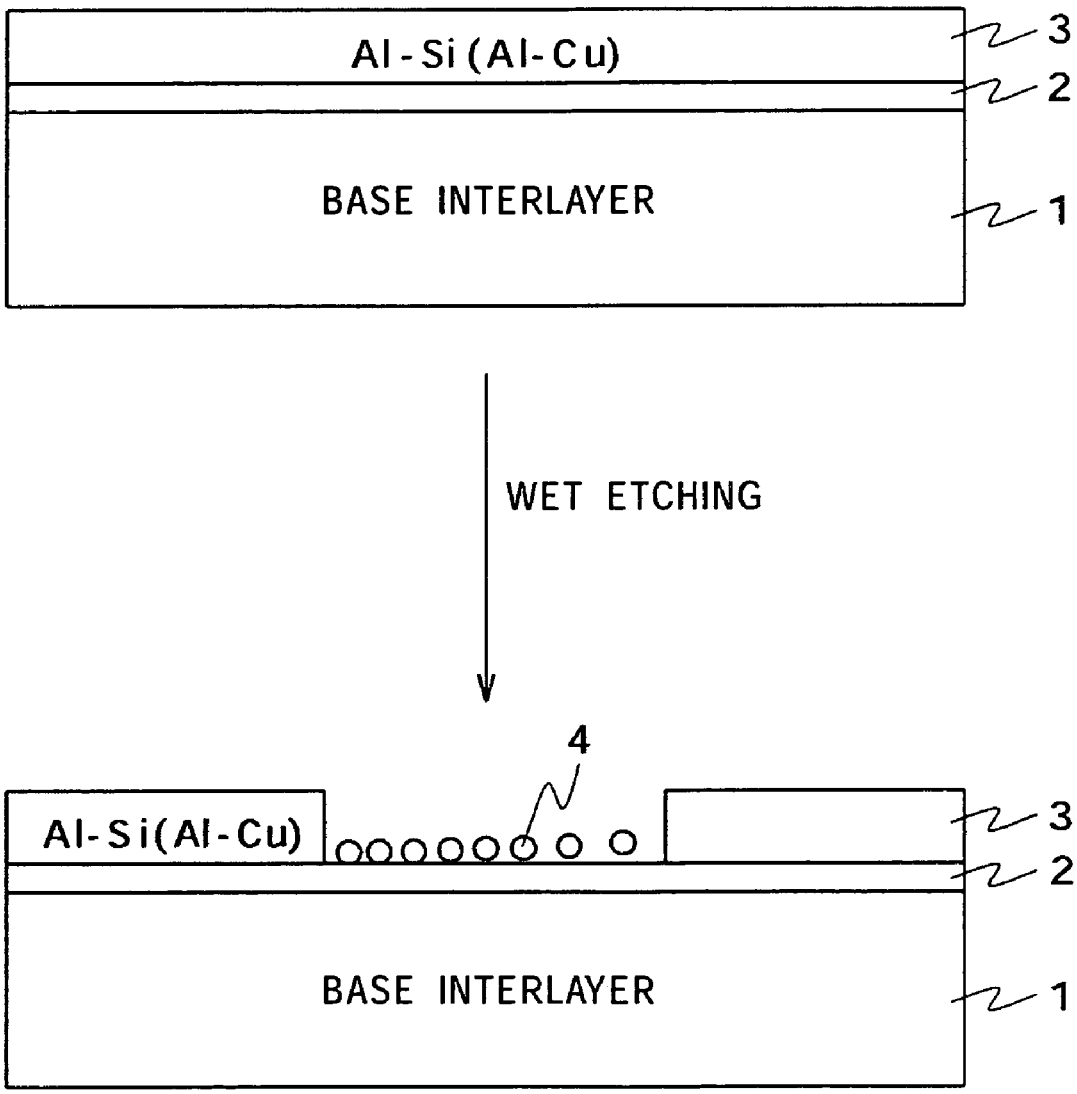
FIG. 1 is a sectional view used for describing residues resulting from wet etching of a wiring pattern.
Figure 2A:
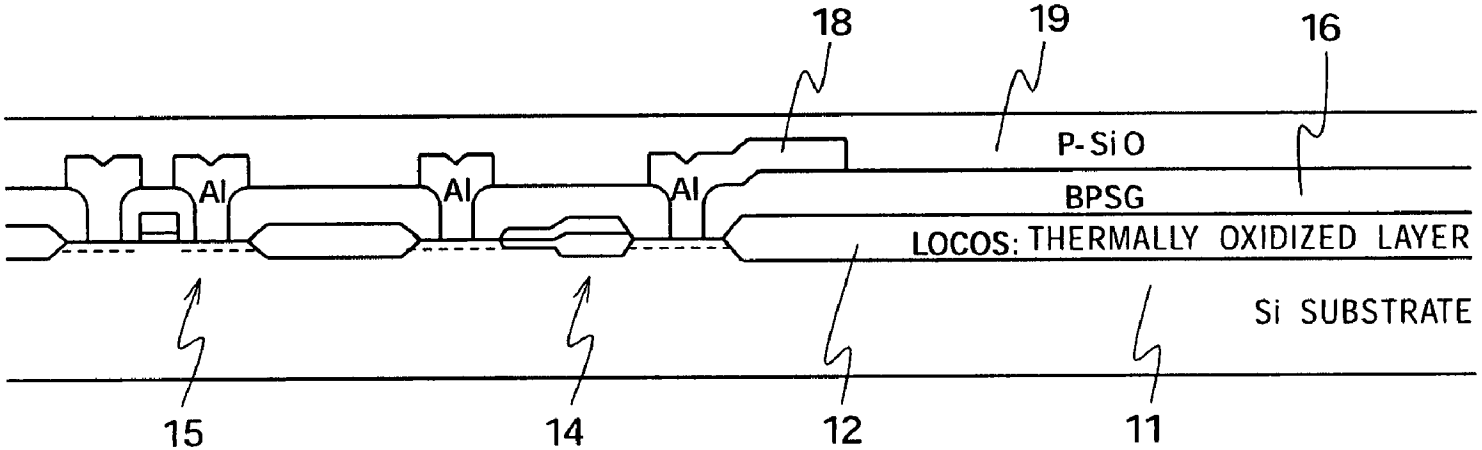
FIGS. 2(A) and (B) are sectional views used for describing a process for manufacturing a printer head according to an embodiment.

FIGS. 2(A) to 5(H) are sectional views used for describing a process for manufacturing a printer head according to an embodiment. In the process, after being cleaned, a p-type silicon substrate 11 is subjected to deposition of a silicon nitride layer, as shown in FIG. 2(A) In the process, the silicon substrate 11 is subsequently subjected to lithography and reactive ion etching to remove the silicon nitride layer from the regions other than predetermined regions where transistors are formed. Thus, in the process, the silicon nitride layer is provided in the regions on the silicon substrate 11 where the transistors are formed.

Then, in the process, a thermally oxidized-silicon layer is formed in the regions from which the silicon nitride layer has been removed to form element separation regions (LOCOS: local oxidation of silicon) 12 for separating transistors. After the silicon substrate 11 is cleaned, a gate having a tungsten silicide/polysilicon/thermally oxidized layer structure in each transistor-forming region. The silicon substrate 11 is further subjected to ion implantation and heat treatment to form source/drain regions, thereby forming MOS switching transistors 14 and 15. One type of switching transistors 14 is used for exciting respective heating elements and has a withstand voltage of about 30 V. On the other hand, the other type of transistors 15 constitutes an integrated circuit for controlling the foregoing driving transistor, and is driven by a voltage of 5 V. Then, in the process, a BPSG (BoroPhosepho Silicate Glass) layer 16 is deposited by CVD (Chemical Vapor Deposition) to form an insulating interlayer.

Contact holes are subsequently formed above the silicon semiconductor diffusion layer (source/drain) by photolithography and reactive ion etching using a CFx gas. Furthermore, the silicon substrate 11 is washed with diluted hydrofluoric acid, and a titanium layer and a titanium nitride barrier metal are deposited in that order at respective thicknesses of 20 and 50 nm, by sputtering. Moreover, aluminium containing 1 percent of silicon is deposited to a thickness of 600 nm. Then, photolithography and dry etching are performed to form a first wiring pattern 18. Thus, the wiring pattern 18 formed of a wiring material having an enhanced electromigration resistance connects the MOS transistors 15 constituting a driving circuit to from a logic integrated circuit.

Then, in the process, a silicon oxide layer (so-called TEOS) 19 serving as an insulating interlayer is deposited by CVD, and is subsequently planarized by CMP (Chemical Mechanical Polishing) or a resist etch back technique.

Figure 2B:
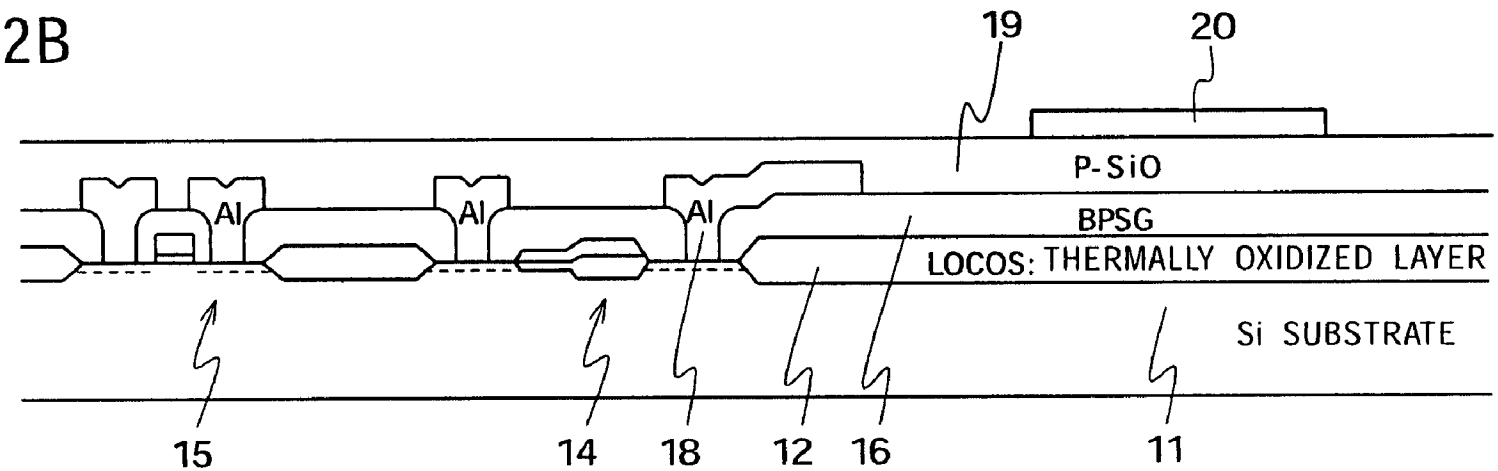

Turning to FIG. 2(B), after the deposition of the insulating interlayer, a heating resistor material, such as Ta, $Ta_2N$, or TaAl, is deposited at a predetermined thickness by sputtering, and the excess heating resistor material is removed by photolithography and dry etching. Thus, heating elements 20 are formed.

Figure 3C:
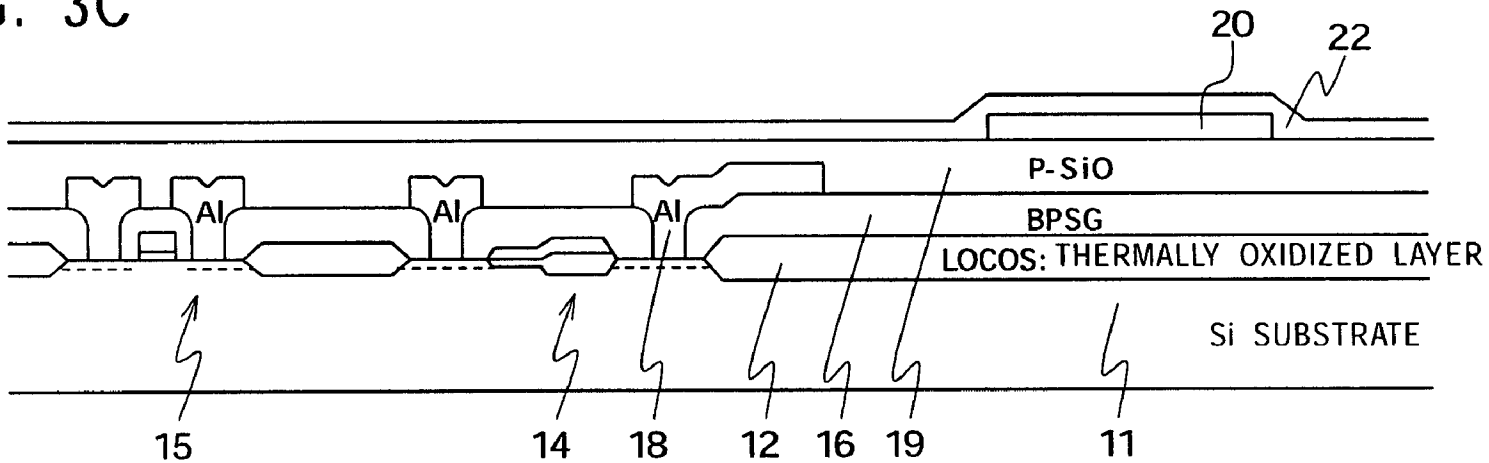
FIGS. 3 (C) and (D) are sectional views used for the description following FIG. 2.

Then, as shown in FIG. 3(C), SiN or SiC is deposited at a predetermined thickness by CVD to form a protective layer 22 for protecting the heating elements 20 from dry etching of a wiring material. The protective layer 22 has a sufficient thickness (100 nm or more).

Figure 3D:
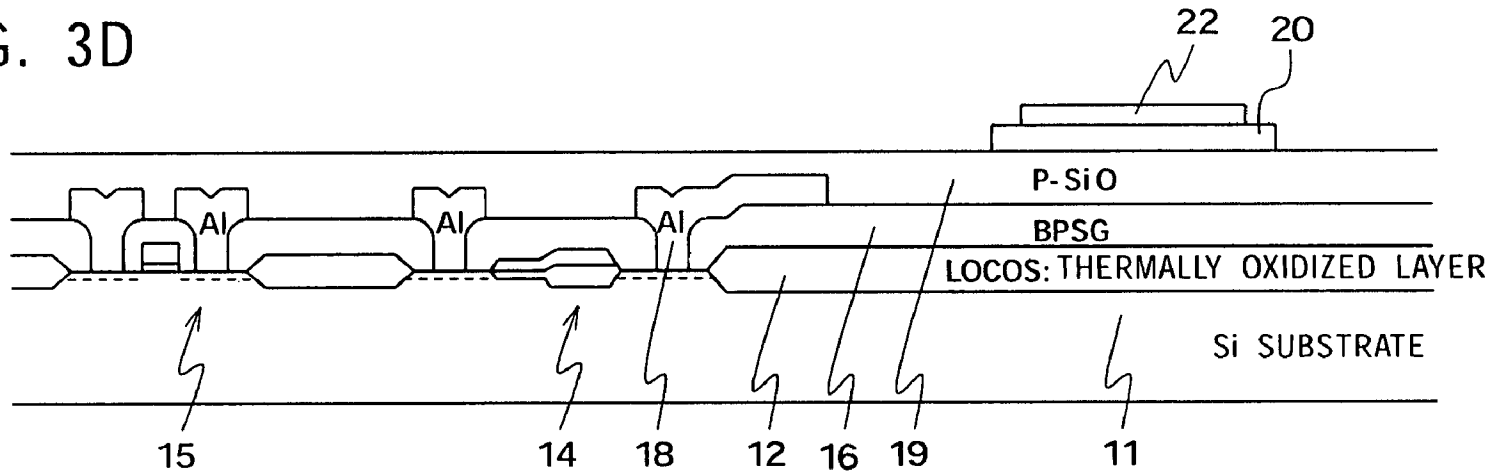

Turning to FIG. 3(D), after lithography, the protective layer 22 is subjected to dry etching using plasma of mainly a CFx gas to remove the regions to be connected with a wiring pattern so that the protective layer 22 is provided only on the heating elements 20.

Figure 4E:
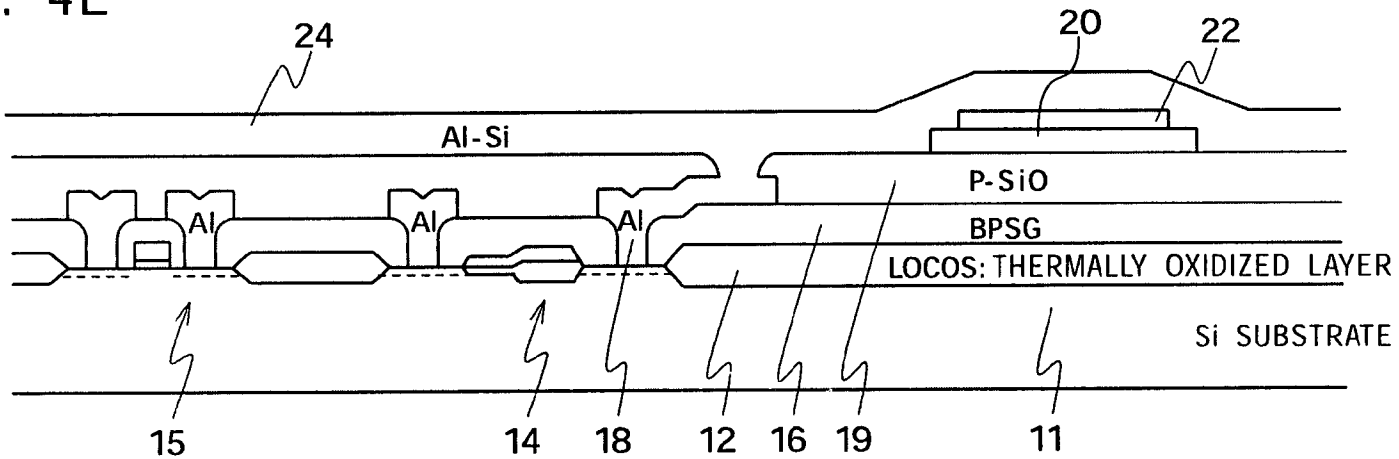
FIGS. 4 (E) and (F) are sectional views used for the description following FIGS. 3.

Then, as shown in FIG. 4(E), contact holes are formed by photolithography and reactive ion etching using a CFx gas. Furthermore, the silicon substrate 11 is washed with diluted hydrofluoric acid, and a titanium layer and a titanium nitride barrier metal are deposited in that order at respective thicknesses of 20 and 50 nm, by sputtering. Moreover, aluminium containing 1 percent of silicon is deposited at a predetermined thickness by sputtering. Thus, a wiring material layer 24 is formed which is connected to the first wiring pattern with the contact holes and to the heating elements 20 at the regions where the heating elements 20 are exposed.

Figure 4F:
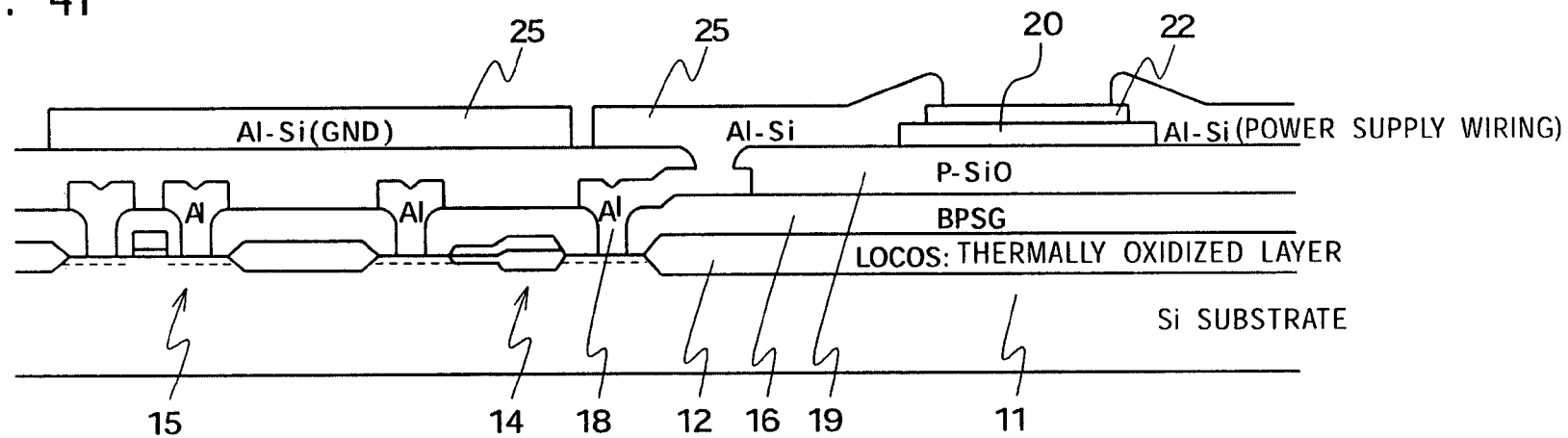

Turning to FIG. 4(F), after a photoresist step, the resulting wiring material layer 24 is subjected to anisotropic dry etching using chlorine gas plasma to form a second wiring pattern 25. The second wiring pattern 25 serves as a power source wire and a grounding wire and also serves to connect the driving transistors 14 to the heating elements 20.

In this instance, etching time is set so long as to sufficiently over-etching the wiring material layer 24, thereby completely removing the wiring material without remaining in stepped regions. Thus, a short circuit in the wiring pattern resulting from the remaining wiring material can sufficiently be prevented.

Figure 5G:
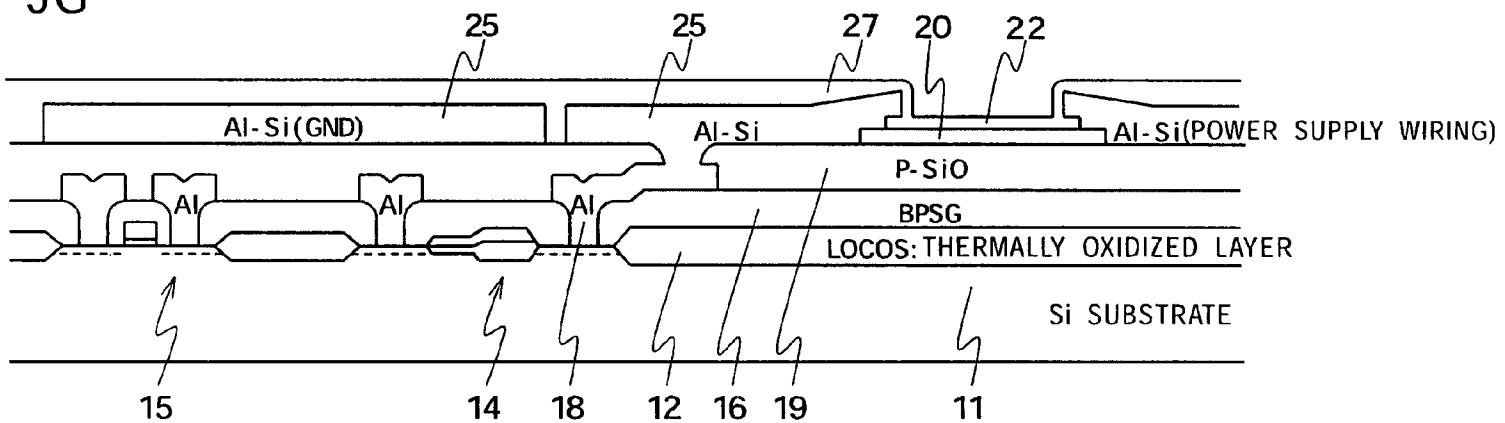
FIGS. 5 (G) and (H) are sectional views used for the description following FIG. 4.
Figure 5H:
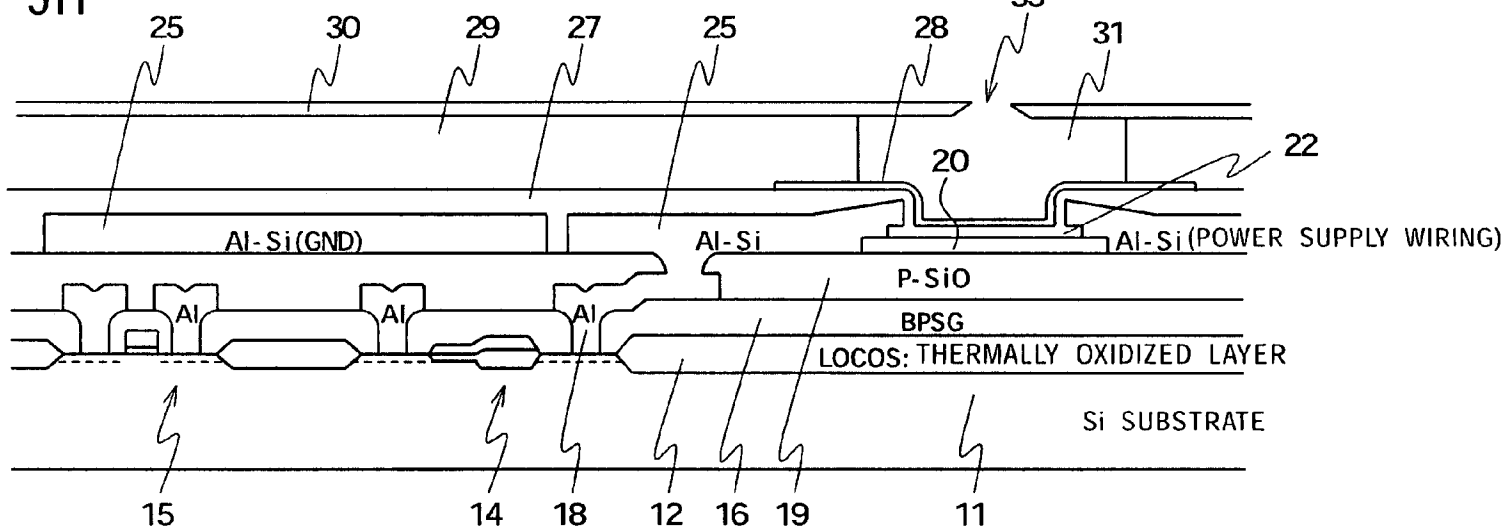

Then, in the process, a silicon nitride layer 27 serving as an ink protection layer is deposited at a thickness of 300 nm, as shown in FIG. 5(G). A tantalum layer is subsequently deposited at a thickness of 200 nm by sputtering, as shown in FIG. 5(H) to form an anti-cavitation layer 28. Then, a dry film 29 and a nozzle sheet 30 are deposited in that order. The dry film 29 is constituted of, for example, a carbon resin, and is formed in a predetermined shape at a predetermined thickness so as to define ink chambers and walls of ink channels having a predetermined height, by curing. On the other hand, the nozzle sheet 30 is formed in a predetermined shape so as to define nozzles 33 from which ink is discharged, above the heater elements 20. The nozzle sheet 30 is supported on the dry film 29 by adhesion. Thus, the ink chambers 31, the channels for drawing the ink to the ink chambers 31, and the nozzles 33 are formed with the dry film 29 and the nozzle sheet 30.

(2) Operation of the Embodiment

In order to manufacture a printer head, in a process for manufacturing a printer head according to the embodiment, the semiconductor substrate 11 including the transistors 14 and 15, which are formed by treating the semiconductor substrate 11, is prepared (FIG. 2(A)), and the insulating interlayer 19, the wiring patterns 18 and 25, the dry film 29, the nozzle sheet 30, and other layers are deposited one by one on the semiconductor substrate 11 (FIGS. 2(B) to 5(H)).

In this manufacturing process, when the layers are deposited one by one, the first wiring pattern 18 is formed of Al—Si having an enhanced electromigration resistance, and then, the heating elements 20 are formed with the insulating interlayer 19 between the first wiring pattern 18 and the heating elements 20. The silicon nitride layer 22 serving as a protective layer against dry etching is further formed on the heating elements 20 to a sufficient thickness. After the wiring material layer 24 is formed of Al—Si having an enhanced electromigration resistance, the wiring material layer 24 is removed by dry etching to form the second wiring pattern 25.

As a result, in the printer head manufactured in this process, the regions corresponding to the heating elements 20 are exposed to chlorine plasma for dry etching when the second wiring pattern is formed by the dry etching. However, in the embodiment, since the regions to be exposed is covered with the protective layer 22 against dry etching formed of silicon nitride (or silicon carbide) to a sufficient thickness, the chlorine plasma is prevented from directly affecting the heating elements 20. Therefore, the deterioration of the reliability of the heating elements can be prevented effectively even though the wiring pattern is formed of the wiring material having an enhanced electromigration resistance. Thus, satisfactory reliability of the heating element is ensured.

Moreover, in the dry etching for forming the second wiring pattern in the embodiment, over etching is performed so sufficiently that the wiring material does not remain in stepped regions. As a result, in the resulting printer head, a short circuit in the wiring pattern resulting from the remaining wiring material can be prevented effectively, and, consequently, reliability can be increased.

By providing the protective layer 22, the heating elements 20 are positioned apart from the respective ink chambers 31 by the thickness of the protective layer 22. However, SiN or SiC constituting the protective layer 22 has a thermal conductivity higher than that of a silicon oxide layer ($SiO_2$). The heating elements can, therefore, heat the ink in the ink chambers so sufficiently as to discharge ink droplets, even though the protective layer 22 is provided.

Figure 6:
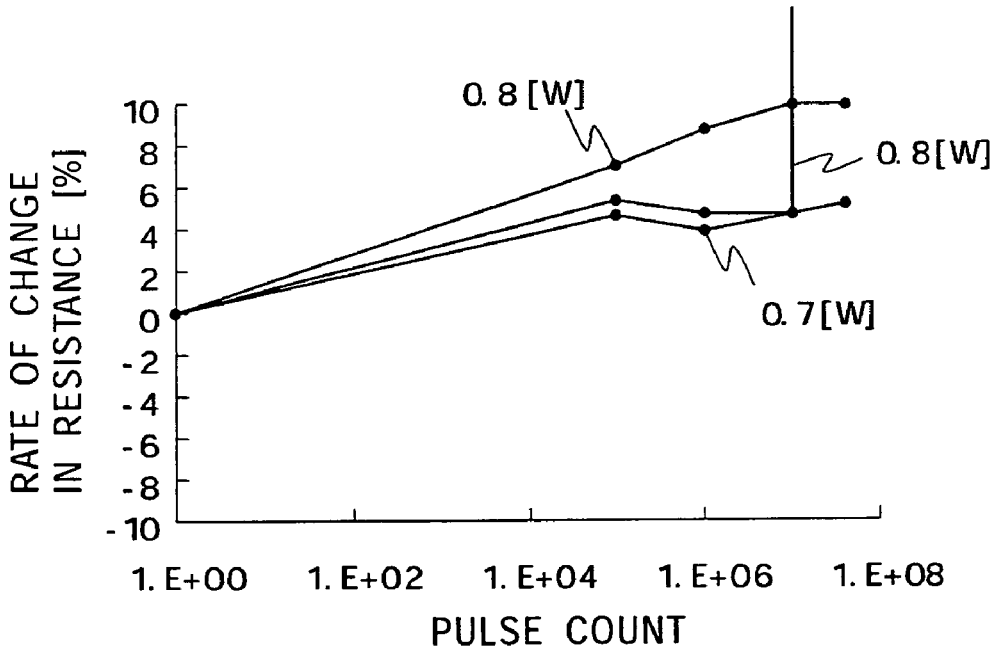
FIG. 6 is a characteristic representation of changes in resistance of a heating element.
Figure 7:
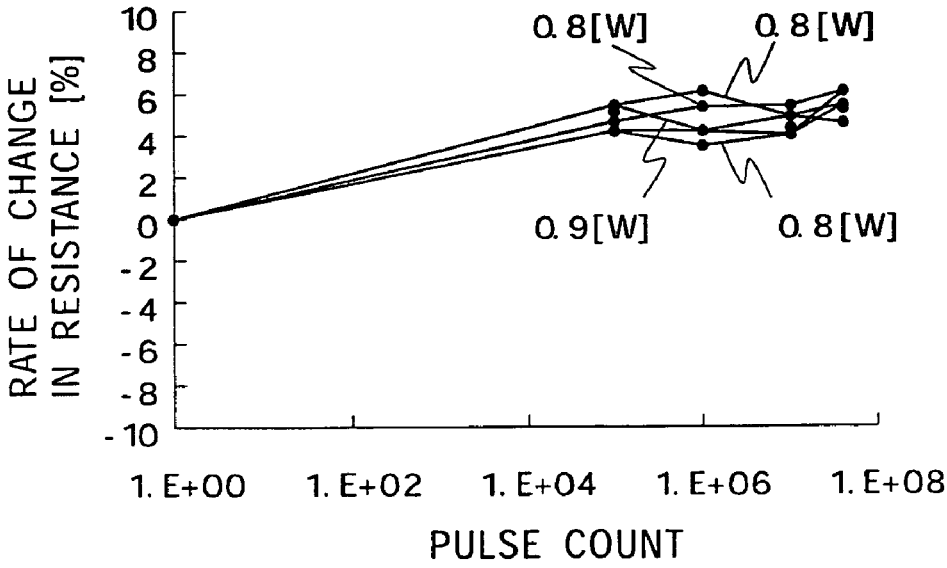
FIG. 7 is a characteristic representation of changes in resistance of a heating element under conditions different from those in FIG. 6.

FIGS. 6 and 7 show the results of tests for checking the reliability of the protective layer 22 formed as in above. The tests were performed on square heating elements of 18 μm in side length by repeatedly applying pulsed electric power. In the tests, head chips were prepared by depositing a SiN layer serving as an ink barrier layer to a thickness of 300 nm and further depositing a tantalum anti-cavitation layer to a thickness of 200 nm. FIG. 6 shows the case where the protective layer 22 was formed such that the thickness of the portion of the protective layer 22 whose thickness was reduced to the smallest value by dry etching was 30 nm. When pulses of 0.8 W were repeatedly applied to the test pieces, the resistance of the heating element increased seriously, and a break in wiring occurred in one of the test pieces at the count of about $10^7$. FIG. 7 shows the case where the protective layer 22 was formed such that the thickness of the portion of the protective layer 22 whose thickness was reduced to the smallest value by dry etching was 100 nm. When pulses of 0.8 W were repeatedly applied to the test pieces and when pulses of 0.9 W were repeatedly applied, changes in the resistivity were reduced to about 5% with respect to the initial value.

(3) Effects of the Embodiment

According to the above-described structure, by providing the protective layer for protecting the heating elements from dry etching for forming the wiring pattern, on the ink chamber side of the heating elements, satisfactory reliability can be ensured even though the wiring pattern is formed of a wiring material having an enhanced electromigration resistance.

By forming the protective layer of silicon nitride or silicon carbide, the ink in the ink chambers can efficiently be heated even though the protective layer is provided between the ink chambers and the heating elements.

(4) Another Embodiment

Although the embodiment illustrates the case where the protective layer is formed of silicon nitride or silicon carbide, it is not limited to the use of these materials. The protective layer may be formed of silicon oxide if the ink in the ink chambers is efficiently heated.

Although the embodiment illustrates the case where the wiring pattern is formed of a wiring material having an enhanced electromigration resistance, the present invention is not limited to this, and may widely be applied to cases where the wiring pattern is formed of various wiring materials by dry etching.

Although the embodiment illustrates the case where the present invention is applied to a printer head and a printer discharging ink droplets, the present invention is not limited to these, and may widely be applied to various apparatuses, such as a printer head discharging droplets of various types of dyes or droplets for forming a protective layer; a microdispenser, a measuring device, and a testing apparatus discharging droplets of a reagent; and a pattern drawing apparatus discharging droplets of a chemical for protecting members from etching.

According to the above-described structure, by providing the protective layer for protecting the heating elements from dry etching for forming the wiring pattern, on the ink chamber side or other liquid chamber side of the heating elements, satisfactory reliability can be ensured even though the wiring pattern is formed of a wiring material having an enhanced electromigration resistance.

INDUSTRIAL APPLICABILITY

The present invention relates to liquid jet heads, liquid jet apparatus, and method for manufacturing a liquid jet head, and is particularly applied to a liquid jet apparatus using a thermal head.

The invention claimed is:

1. A liquid jet head comprising:

a semiconductor substrate;

a heating element disposed above the semiconductor substrate with a wiring material therebetween, said heating element comprising a metal compound or a metallic compound; and a protective layer disposed only on the heating element for protecting the heating element from dry etching of the wiring material;

wherein the protective layer comprises silicon nitride or silicon carbide.

2. A liquid jet head according to claim 1, wherein said metal compound or said metallic compound contains tantalum or a tantalum compound.

3. A liquid jet head according to claim 1, further comprising a liquid chamber in thermal relationship with the heating element; and a liquid protection layer on the protective layer for protecting the heating element from a liquid in the liquid chamber.

4. A liquid jet head according to claim 1, further comprising a nozzle above the heating element.

5. A liquid jet apparatus for preparing a printed material comprising:

a semiconductor substrate;

a heating element disposed above the semiconductor substrate with a wiring material therebetween, said heating element comprising a metal compound or a metallic compound;

a nozzle for discharging droplets by exciting the heating element; and a protective layer disposed only on the heating element for protecting the heating element from dry etching of the wiring material;

wherein the protective layer comprises silicon nitride or silicon carbide.

6. A liquid jet apparatus according to claim 5, wherein said metal compound or said metallic compound contains tantalum or a tantalum compound.

7. A liquid jet apparatus according to claim 5, further comprising a liquid chamber in thermal relationship with the heating element; and a liquid protection layer on the protective layer for protecting the heating element from a liquid.

8. A liquid jet apparatus according to claim 5, further comprising a nozzle above the heating element.

9. A liquid jet head comprising:

a semiconductor substrate;

an insulating layer disposed above the semiconductor substrate;

a heating element disposed above the insulating layer, said heating element comprising a metal compound or a metallic compound;

a wiring material between the semiconductor substrate and the heating element; and a protective layer disposed only on the heating element for protecting the heating element from dry etching of the wiring material, wherein the protective layer comprises silicon nitride or silicon carbide.

10. A liquid jet head according to claim 9, wherein said metal compound or said metallic compound contains tantalum or a tantalum compound.

11. A liquid jet head according to claim 9, further comprising a liquid chamber in thermal relationship with the heating element; and a liquid protection layer on the protective layer for protecting the heating element from a liquid in the liquid chamber.

12. A liquid jet head according to claim 9, further comprising a nozzle above the heating element.

* * * * *